US008596204B2

(12) United States Patent
Costamagna

(10) Patent No.: US 8,596,204 B2
(45) Date of Patent: Dec. 3, 2013

(54) WORK STATION FOR COMPUTERS AND THE LIKE, PARTICULARLY FOR DIDACTIC USE

(75) Inventor: Daniele Costamagna, Turin (IT)

(73) Assignee: Unidida S.R.L., Turin (IT)

( * ) Notice: Subject to any disclaimer, the term of this patent is extended or adjusted under 35 U.S.C. 154(b) by 0 days.

(21) Appl. No.: 13/262,393

(22) PCT Filed: Mar. 29, 2010

(86) PCT No.: PCT/IB2010/051350

§ 371 (c)(1),
(2), (4) Date: Sep. 30, 2011

(87) PCT Pub. No.: WO2010/113099

PCT Pub. Date: Oct. 7, 2010

(65) Prior Publication Data

US 2012/0026663 A1 Feb. 2, 2012

(30) Foreign Application Priority Data

Mar. 31, 2009 (IT) ..... TO2009A0246

(51) Int. Cl.
*A47F 5/12* (2006.01)

(52) U.S. Cl.
USPC ..... 108/6; 108/3; 108/39; 108/50.01; 312/223.3; 312/208.1

(58) Field of Classification Search
USPC ..... 312/223.3, 194, 195, 196, 208.1, 313, 312/351.5; 108/3, 6, 25, 33, 39, 50.01, 108/50.02, 93, 11, 17, 14
See application file for complete search history.

(56) References Cited

U.S. PATENT DOCUMENTS 1,217,025 A * 2/1917 Levett ..... 220/819
2,223,405 A * 12/1940 Cain ..... 108/3

(Continued)

FOREIGN PATENT DOCUMENTS

| | | | |
|---|---|---|---|
| DE | 9408151 | U1 | 7/1994 |
| DE | 29715923 | U1 | 11/1997 |
| EP | 0378889 | A1 | 7/1990 |
| EP | 1726238 | A1 | 11/2006 |

OTHER PUBLICATIONS

Notification of Transmittal of International Search Report and Written Opinion for corresponding International Application No. PCT/IB2010/051350 mailed on Feb. 2, 2011 and completed on Jan. 25, 2011.

*Primary Examiner* — Daniel Rohrhoff
(74) *Attorney, Agent, or Firm* — Heslin Rothenberg Farley & Mesiti P.C.; Victor A. Cardona, Esq.

(57) ABSTRACT

A workstation has a structure including a work top and upright elements supporting the work top, and an electronic display device mounted on the work top. The work top includes a lower board, stably coupled to the upright elements, and an upper board, displaceable with respect to the lower board and subdivided into at least one front board part and one rear board part articulated to each other. The display device is substantially flat and is secured in a laying position substantially parallel to the front board part. The front board part and the rear board part are articulated to each other according to a substantially horizontal axis, such that the upper board is adapted to selectively take on a plurality of different configurations, corresponding to which different positions of use of the display device.

18 Claims, 8 Drawing Sheets

(56) References Cited

U.S. PATENT DOCUMENTS

| | | | | | |
|---|---|---|---|---|---|
| 2,316,756 | A | * | 4/1943 | Balster | 312/30 |
| 2,931,685 | A | * | 4/1960 | Butler | 312/196 |
| 2,973,603 | A | * | 3/1961 | De Vincenzo | 108/9 |
| 4,145,097 | A | * | 3/1979 | Naess et al. | 312/223.3 |
| 4,766,422 | A | * | 8/1988 | Wolters et al. | 312/198 |
| 5,558,418 | A | * | 9/1996 | Lambright et al. | 312/321.5 |
| 5,896,817 | A | * | 4/1999 | Hancock | 108/50.01 |
| 5,931,103 | A | * | 8/1999 | Huang | 108/50.02 |
| 5,957,059 | A | * | 9/1999 | Burhman | 108/13 |
| 6,164,218 | A | * | 12/2000 | Donalson | 108/144.11 |
| 6,286,440 | B1 | * | 9/2001 | Jyringi | 108/50.01 |
| 6,312,069 | B1 | * | 11/2001 | Weng | 312/312 |
| 6,766,747 | B1 | * | 7/2004 | Wolfe | 108/26 |
| 7,029,079 | B2 | * | 4/2006 | Holt | 312/223.3 |
| 7,757,612 | B2 | * | 7/2010 | Korber et al. | 108/25 |
| 7,859,836 | B2 | * | 12/2010 | Bae | 361/679.55 |
| 2006/0027146 | A1 | * | 2/2006 | Lee | 108/6 |
| 2006/0191445 | A1 | * | 8/2006 | Stengel et al. | 108/50.01 |
| 2007/0000414 | A1 | * | 1/2007 | Riddiford et al. | 108/50.01 |
| 2011/0168062 | A1 | * | 7/2011 | Dellavecchia | 108/7 |

* cited by examiner

WORK STATION FOR COMPUTERS AND THE LIKE, PARTICULARLY FOR DIDACTIC USE

CROSS REFERENCE TO RELATED APPLICATIONS

This application is a national stage of PCT International Application No. PCT/IB2010/051350, filed on Mar. 29, 2010, and published in English on Oct. 7, 2010, as WO 2010/113099 A2, which claims priority from Italian Patent Application No. TO2009A000246 filed on Mar. 31, 2009, the entire disclosures of which are incorporated herein by reference.

The present invention refers ad a work station for computers and the like, according to the preamble of claim 1.

A work station of this kind is disclosed by EP-A-0 378 889.

DE-U 297 15 923 discloses a school desk having a work board subdivided into a front board part and at least one rear board part. The two board parts are articulated to rotate relative to each other about a horizontal axis, such that the rear board part of the work board can be raised, to approach and face the desk user. The invention has the main object of providing a work station suitable to integrate information technologies capable of allowing a high degree of interaction between the user and the machine and/or high comfort in use, also from an ergonomic point of view, for the user of the workstation. Another object of the invention is that of providing such work station having a structure that is easy to manufacture, inexpensive and compact. Another object of the invention is that of providing a work station useable with particular advantage in the field of didactics, and in particular child didactics.

These and other objects, which shall be clearer hereinafter, are attained according to the present invention by a work station and by a structure of a work station having the characteristics of the attached claims. The claims form an integral part of the technical disclosure provided herein related to the invention.

Now, the invention shall be described in detail with reference to the attached drawings, strictly provided for exemplifying and non-limiting purposes, wherein.

Figure 1:
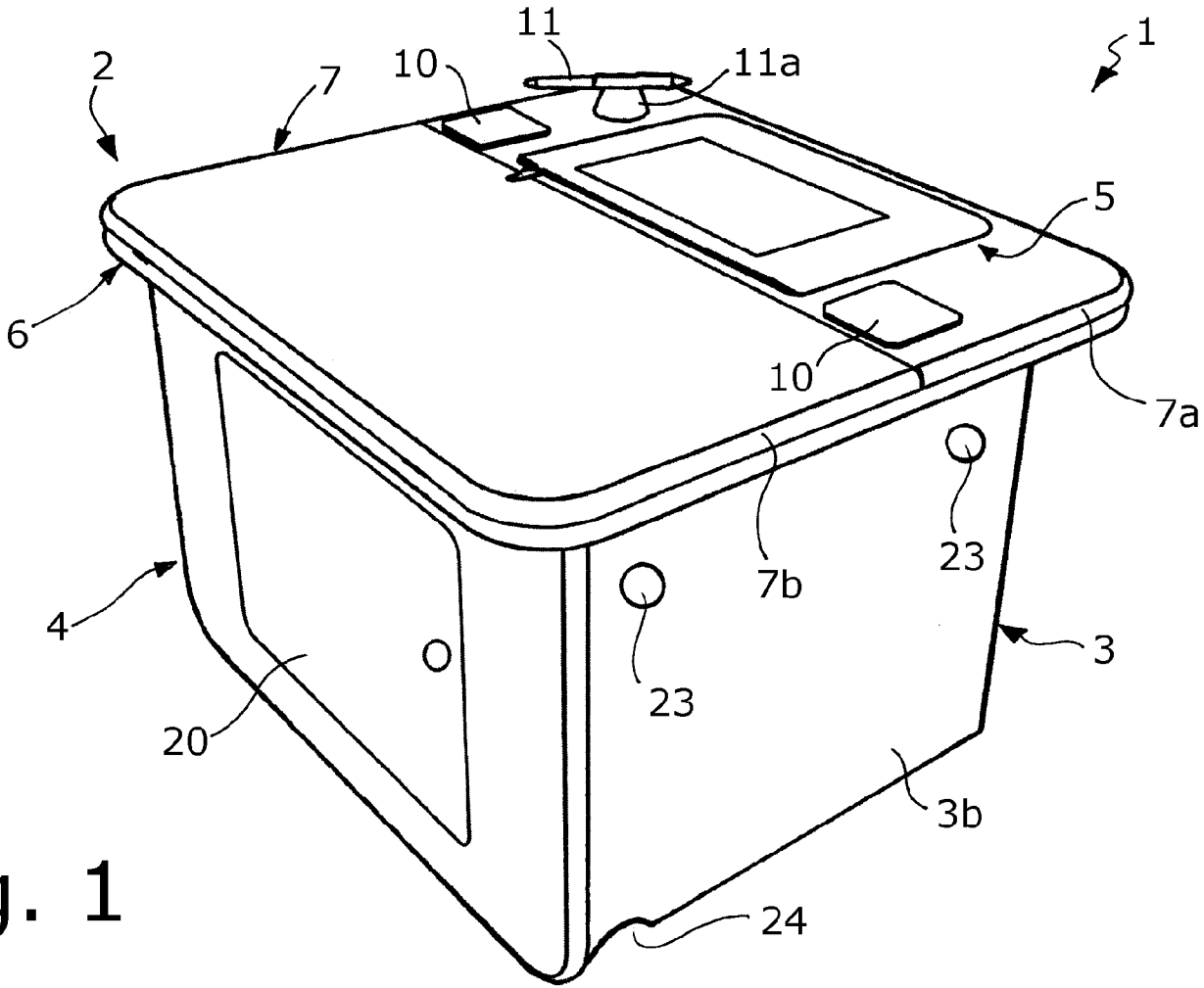
FIGS. 1, 2, 3 and 4 are perspective views of a work station according to the present invention, with a respective upper board in different configurations.

In the figures, a work station according to the present invention is indicated in its entirety with 1. In the illustrated embodiment, the workstation 1 has a bearing structure essentially configured like a school desk, but such characteristic shall not be considered in the restrictive sense, though the invention finds particularly advantageous application in the field of child didactics. The structure of the work station 1 comprises a work top, indicated generally with 2 in FIG. 1, which is supported by two parallel lateral uprights, or sides, indicated with 3. The structure further comprises a rear panel, indicated with 4, for example integrally joined with the sides 3 and substantially orthogonal thereto. Mounted on the work top 2 is an electronic display device 5.

According to a characteristic of the invention, the work top 2 comprises a lower board 6 and an upper board 7, overlapped with respect to each other, the lower surface of the board 7 facing and being substantially adjacent to the upper surface of the board 6. The lower board 6, for example made up of a wooden table, is stably coupled at least to the sides 3, through per se known means. According to the invention, the upper board 7 is configured in such a manner to be displaceable with respect to the lower board 6, and it is—for this purpose—subdivided into at least two board parts articulated to each other, indicated with 7*a* and 7*b*, also obtainable for example by means of wooden tables. Hereinafter, the two parts 7*a* and 7*b* shall also be referred to as "front part" and "rear part", respectively, with reference to the typical position acquired by a user of the work station 1; it should be observed, regarding this, that shown in FIGS. 1 and 5 is the rear part of the work station 1, while shown in FIGS. 2-4 and 8 is the front part thereof.

Figure 2:
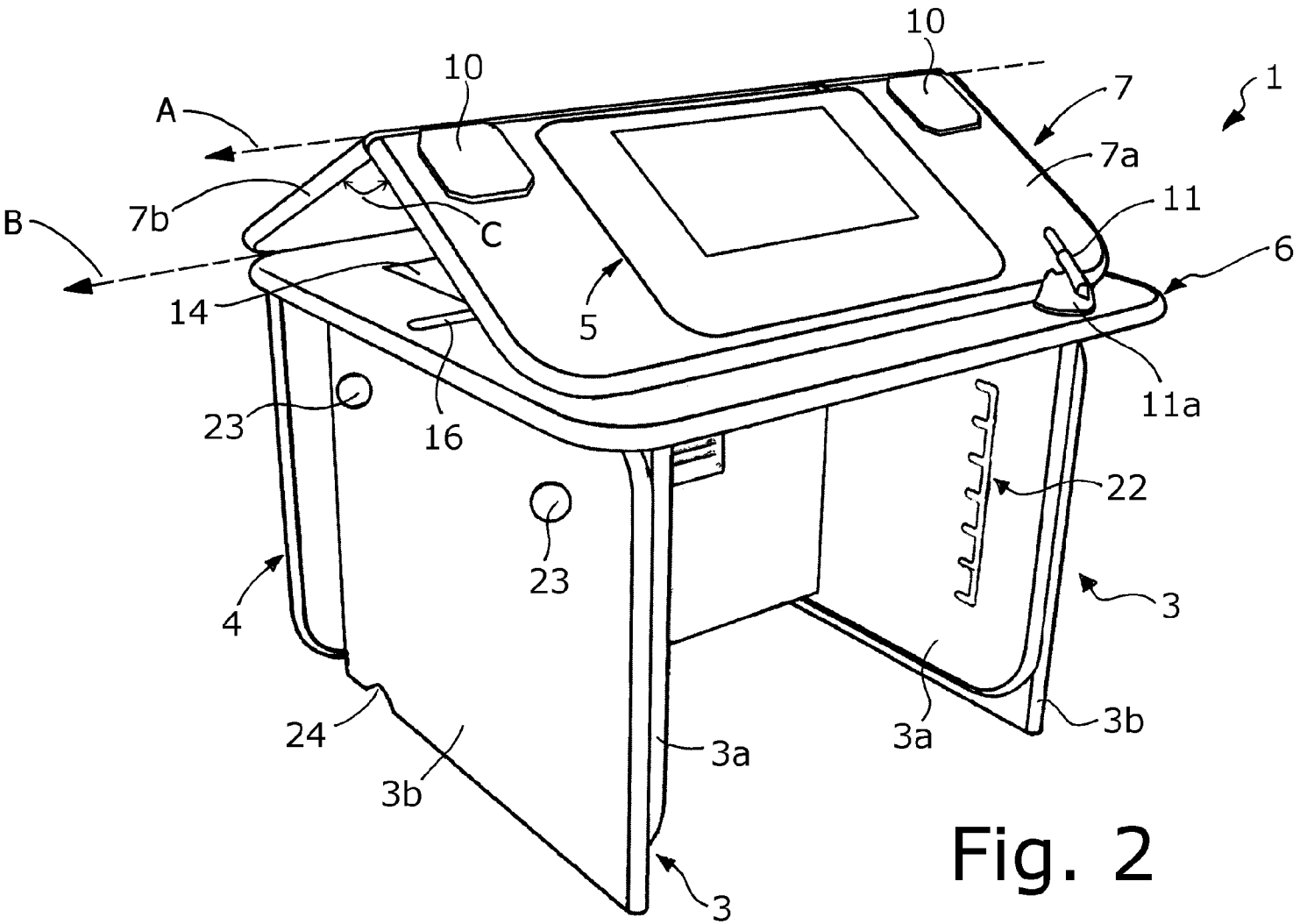

The two parts 7*a* and 7*b* are articulated in such a manner to rotate with respect to each other according to a first axis—designated by A in FIG. 2—which is substantially horizontal, and displaceable. Furthermore, the rear part 7*b* is preferably also articulated to the lower board 6, so as to rotate with respect to the latter according to a further axis, designated by B in FIG. 2, which is substantially horizontal and parallel to the abovementioned first axis A, and in a fixed position relative to the board 6. In particular, as observable for example in FIGS. 3-4, mounted between the rear region of the part 7*a* and the front region of the part 7*b* are articulation means, for example represented by two hinges, partly observable only in FIGS. 3 and 4, where they are indicated with 8, in such a manner to articulate the two parts 7*a*, 7*b* with respect to each other. Furthermore, mounted between the rear region of the part 7*b* and the rear region of the lower board 6 are further second articulation means, also in this case represented by hinges, one of which is indicated with 9 for example in FIG. 3, for articulating the rear part 7*b* to the lower board 6. The electronic device 5 is a display device or screen of the substantially flat type and it is mounted on the front part 7*a*, in a laying position substantially parallel to the same part 7*a*; for such purpose, when required, the part 7*a* is preferably provided with a housing (not visible) inside which the body of the electronic display 5 is inserted at least partly. The display 5 is preferably mounted in a generally central zone of the part 7*a*; mounted at the sides of the display 5 are two speakers, indicated with 10. In addition, preferably mounted at a concealed position above the display 5 is a microphone; connectors for possible headphones and auxiliary microphone are provided for beneath the lower board 6, in the front region of the latter.

In the preferred embodiment of the invention, the device 5 is an interactive screen or display, i.e. serving both as an output device (display) and as an input device (entering data, commands, etcetera); in such context, the display 5 may for example be a touch screen device or—preferably—an interactive pen display. As known, the devices of the first type, also referred to as "touch screens" or "touch-sensitive screen", are hardware devices that, alongside serving as displays for a computer, allow a user to interact with the computer itself by touching the screen. The devices of the second type indicated above have more sophisticated graphic and input functionalities, thus for example allowing drawing or writing directly on the screen of the display, thus emulating drawing or writing by hand on a paper, by means of a special stylus or pen. Examples of displays of this type, useable for implementing the invention, are for example products of the American company Wacom Technology Corporation (www.wacom-europe.com). Thus, in the illustrated example, it should be assumed that the display 5 is of the second type mentioned above, and therefore operatively associated thereto—directly or through a computer unit such as a personal computer—is a pen 11 or similar device for interacting with the display, provided with respective movable support 11*a*.

As mentioned, due to the presence of the hinges 8, the front 7*a* and rear 7*b* parts of the board 7 are articulated to rotate with respect to each other according to a substantially horizontal axis A, which is displaceable. In such manner, the upper board 7 may be moved to selectively acquire a plurality of different configurations, corresponding to which are different positions for using the display 5, among which at least one lowered configuration, wherein the two parts 7*a* and 7*b* are essentially adjacent and parallel to the lower board 6 and substantially coplanar with respect to each other, and at least one raised configuration, wherein the lower surfaces of two parts 7*a* and 7*b* form a lower angle therebetween, designated by C in FIG. 2, which is smaller than 180°.

Observable in FIG. 1 is the abovementioned lowered configuration. As observable, the area defined between the two board 6 and 7 is substantially the same, hence in the lowered configuration the board 7 rests below on the board 6, practically covers it entirely, and defines—at the upper part thereof—a flat surface which mainly accommodates the display 5. In this position, the display 5 is thus substantially horizontal and practically appears to the user as an exercise book or interactive book. Under such condition, the user may easily write or draw on the display 5, using the pen 11.

Figure 3:
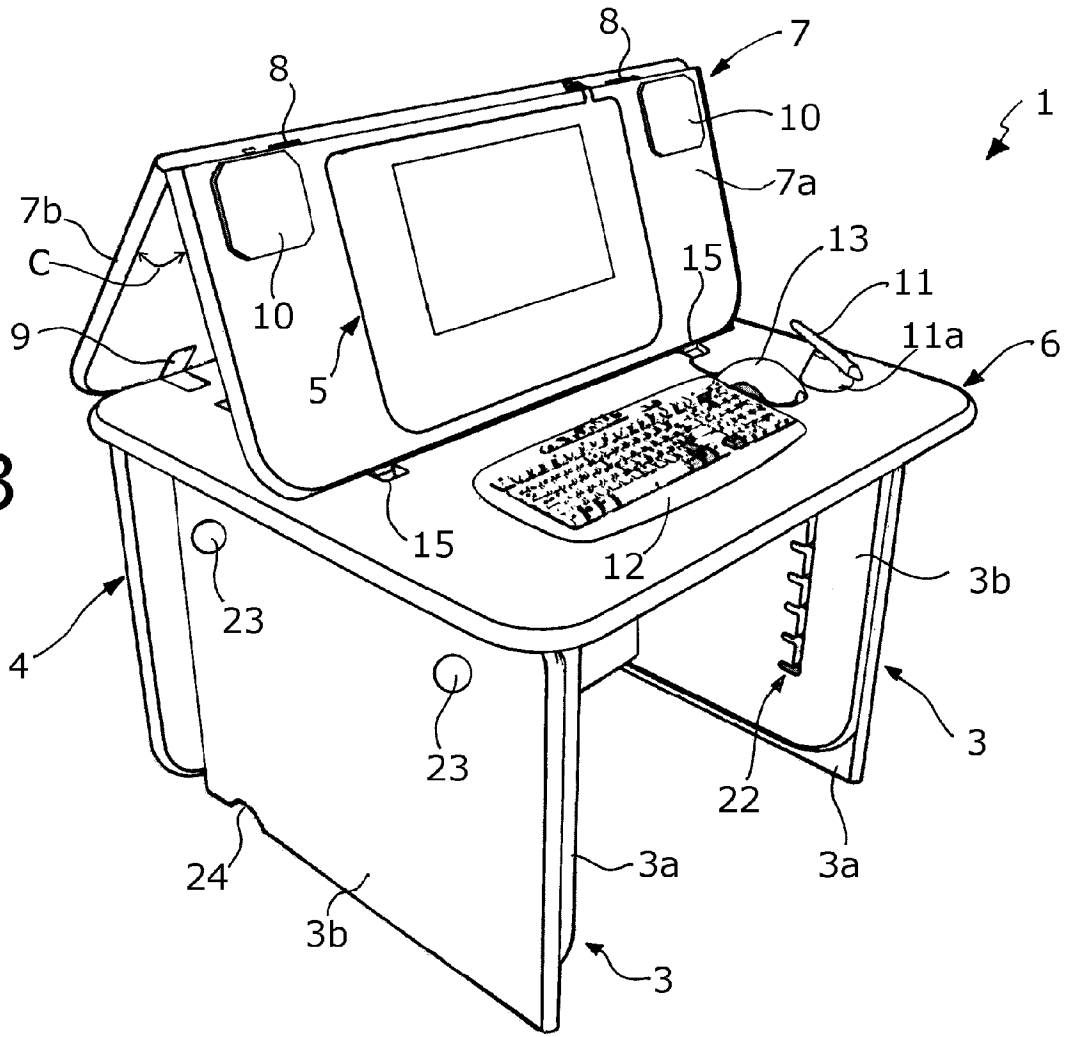

The upper board 7 is preferably suitable to acquire at least one first and one second raised configuration, observable in FIGS. 2 and 3, respectively. As observable, the lower angle C formed between the lower surfaces of the two parts 7*a* and 7*b* is different in the two abovementioned raised configurations, in such a manner that the display 5 is oriented with correspondingly different inclinations towards the user, who is at the front part of the work station 1. In the two raised configurations also the distance between the front part 7*a* and the user is different. The front edge of the upper board 7, regardless of the type of raised configuration acquired, lies on the lower board 6.

As observable, in the position of FIG. 2, the lower board 6 is mainly covered by the upper board 7, whose parts 7*a* and 7*b* form an obtuse lower angle C with respect to each other. This use configuration, which in the example allows exploiting a part of the board 6 where the support 11*a* of the pen 11 lies, is suitable for consultation of information, images, figures, etcetera displayed on the display 5, as well as for the selection interaction with the same display 5, i.e., for example, touching the displayed figures using the pen 11.

In the position of FIG. 3, instead, the lower surfaces of the parts 7*a* and 7*b* form an acute lower angle C with respect to each other, with a substantial portion of the upper surface of the lower board 6 being exposed, and it can thus advantageously provide a surface available for the user, for example for placing an exercise book or for supporting an input device, such as a keyboard 12 and/or a mouse 13 and/or the pen 11 with the respective transmission support/unit 11*a*. The configuration of FIG. 3 is also suitable to be used, on the surface part of the lower board 6 left vacant by the board 7 of a Pen Tablet, i.e. not serving the function of a display, but only as input, allowing simulating drawing or writing by hand using a pen, which may possibly be the same pen 11. In this operating mode, the abovementioned tablet takes the place of the keyboard 12 and mouse 13, that may be kept idle in a compartment or seat of the work station 1, described hereinafter. For didactic purposes, for which the workstation 1 is particularly dedicated, the abovementioned tablet may also be used by placing a paper sheet thereon and writing on it using a special ballpoint and ink pen (such pen may advantageously be the same pen indicated with 11, from which a plastic stylet is removed to be replaced with a refill). This type of pen is already optionally provided alongside some types of pen tablets currently available in the market.

Figure 4:
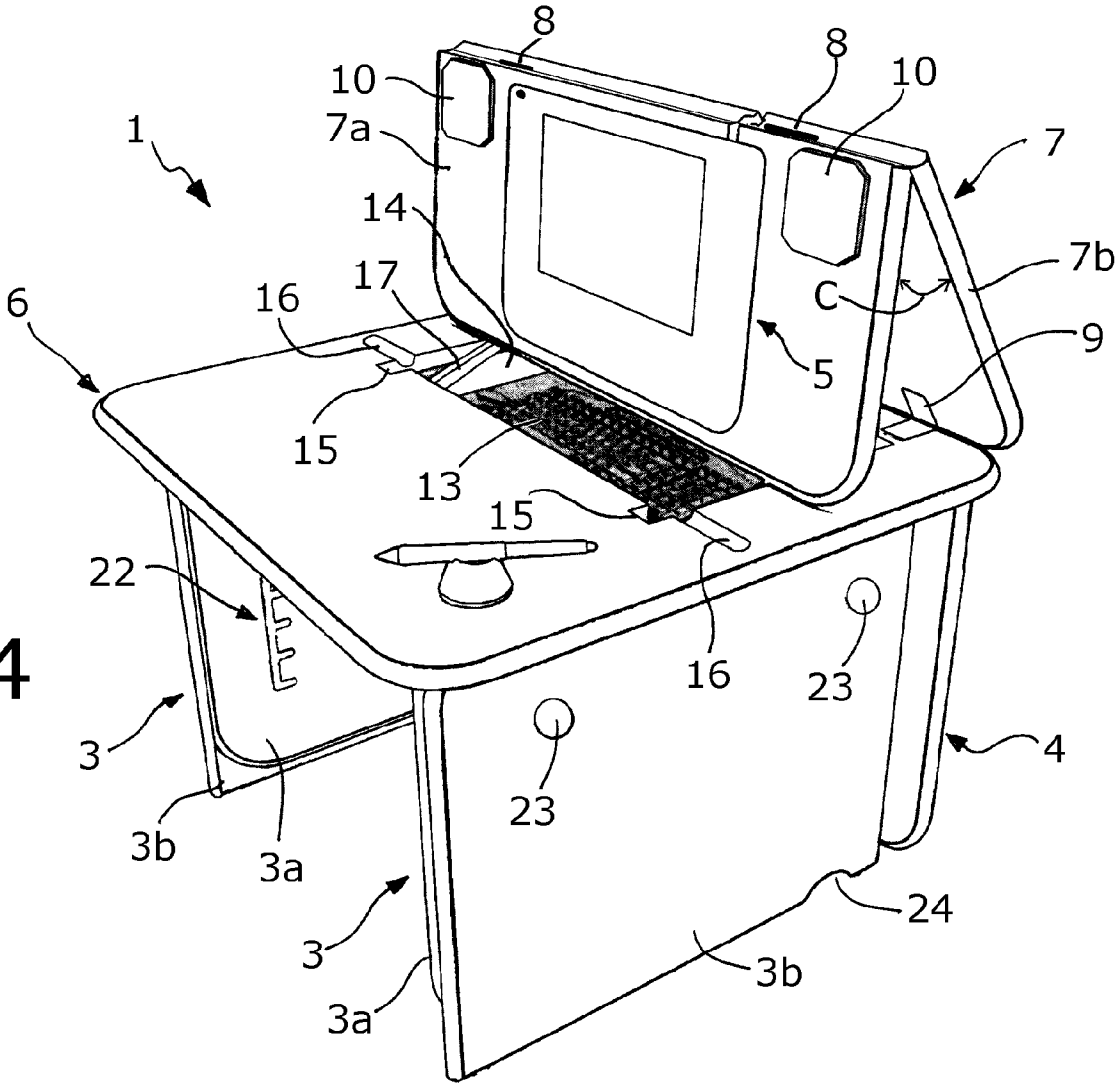
Figure 5:
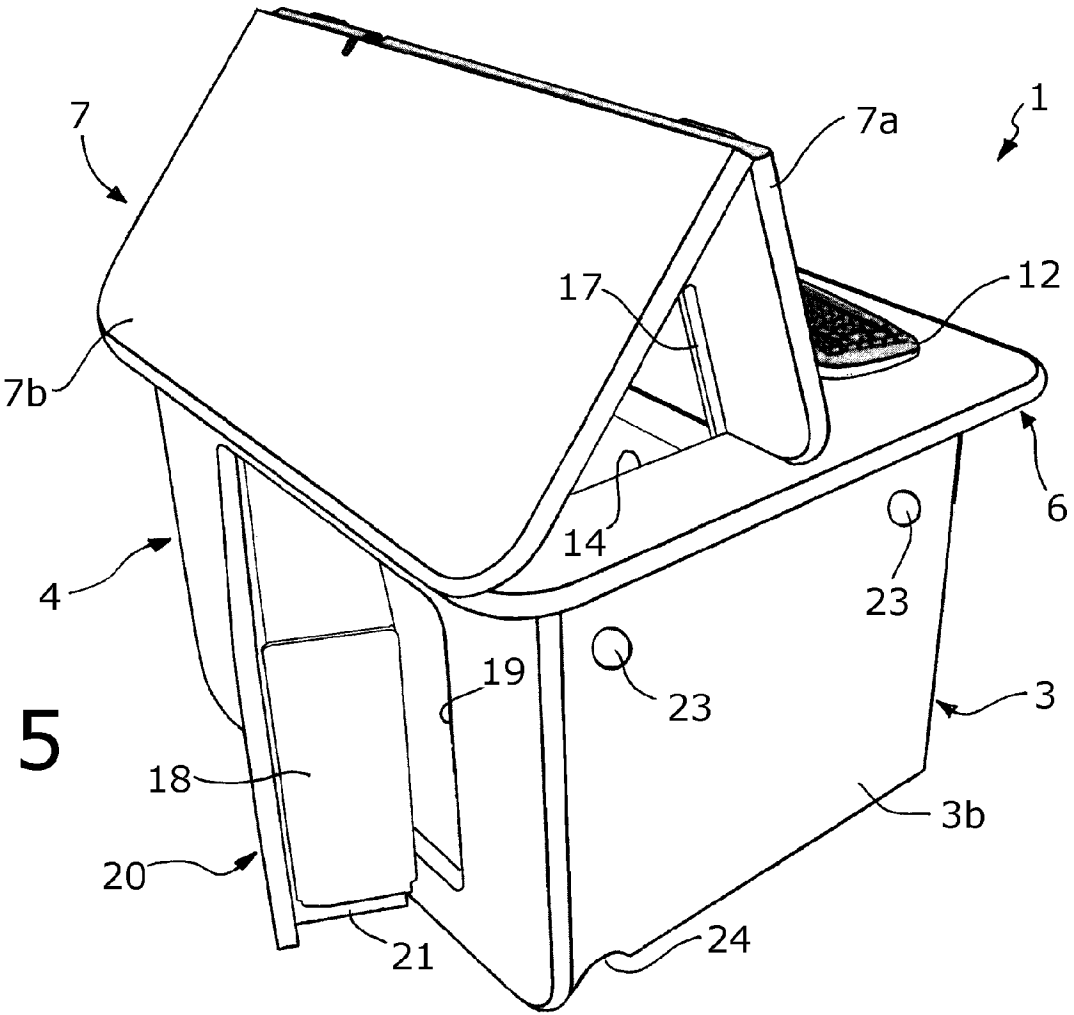
FIG. 5 is a perspective view of a rear part of the work station of FIGS. 1-4.
Figure 7:
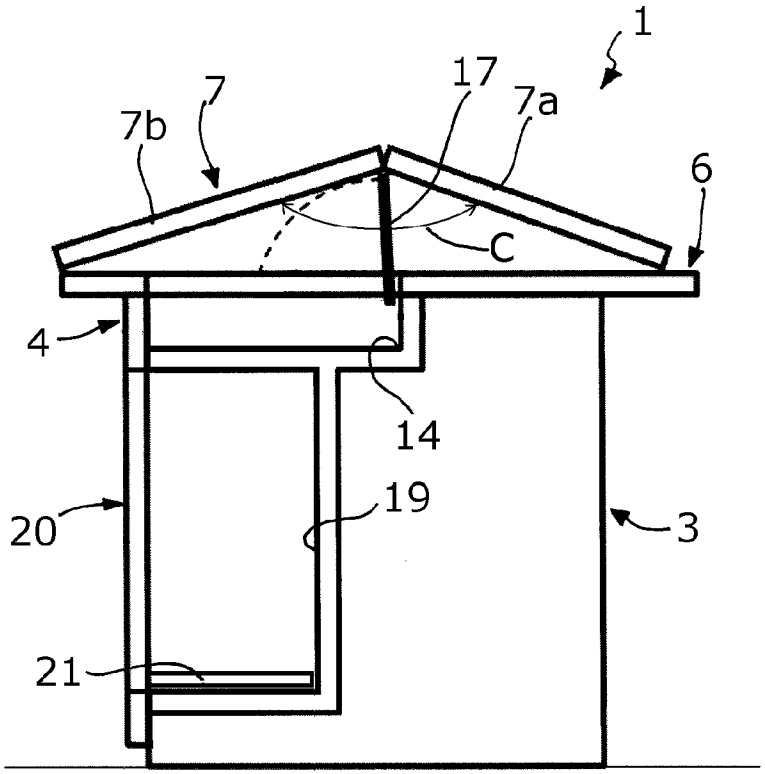
FIGS. 6 and 7 are sectional schematic representations of the work station subject of the invention, in the configurations of FIGS. 1 and 2, respectively.
Figure 6:
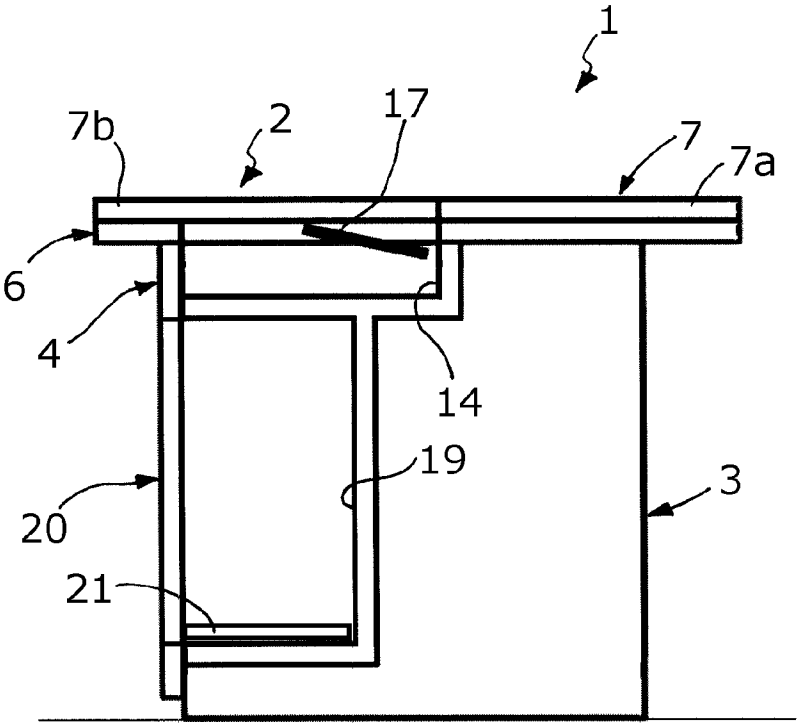

As observable in FIGS. 4 and 5, the lower board 6 is preferably provided with a through opening, which allows access to a compartment or seat 14, defined—at the lower part—at the same board 6 (also see FIGS. 6-7). This seat 14 is particularly provided for placing one or more input devices for a computer, such as the keyboard 12 and the mouse 13. As observable, for example from the comparison between FIGS. 1 and 4, the seat 14 is inaccessible and concealed when the upper board 7 is in the respective lowered configuration; vice versa, by moving—at least temporarily—the upper board 7 to a raised configuration, the seat 14 becomes accessible, allowing the removal of the keyboard 12 and mouse 13. As observable in FIG. 4, the raised configuration of the board 7 which allows complete access to the seat 14 and the removal of the keyboard 12 and/or the mouse 13 is different from the two use configurations illustrated in FIGS. 2 and 3; in the position of FIG. 4, the front part 7*a* of the board 7 has maximum inclination, further receded with respect to that intended for the use of the keyboard and mouse. When provided for, the keyboard 12 and the mouse 13 are preferably always connected to a computer unit, illustrated hereinafter.

FIG. 3 shows how the lower board 6 comprises at least one surface notch or groove 15, which allows the passage—towards the seat 14—of connection cables—for example those of the keyboard 12, mouse 13 and/or pen 11 if provided with a cable; this groove 15 is substantially orthogonal to the front of the work top 2 and positioned in such a manner that, when the upper board 7 is in the position of FIG. 3, a section of the front edge of the part 7*a* is found thereon. Advantageously provided for are two grooves 15, which also accommodate the exposed part of the hinges 8 which join the two parts 7*a*, 7*b* of the upper board 7, when the latter is in the lowered flat configuration of FIG. 1.

The raised configurations are obtained simply, by manually rotating one of the two parts 7*a* or 7*b* with respect to the other, around the axis A of the hinges 8; for such purpose, for example, one of the board parts may be pulled upwards, preferably in proximity to the region of articulation between the parts themselves: in such manner, the two parts are progressively inclined with respect to each other, with the front edge of the first part 7*a* laying on the lower board 6 and sliding thereon, and with the lower surfaces of the two parts 7*a* e 7*b* approaching each other, forming the more or less wide angle C. With reference to the example, in each raised configuration, axis A between the two board parts 7*a* and 7*b* lies higher than the articulation axis B of the part 7*b* to the lower board 6.

The structure of the work station 1 is provided with stop means, for keeping the front 7*a* and rear 7*b* parts of the board 7 at a determined raised configuration. In the exemplified embodiment, provided for such purpose are first stop means, for keeping the board 7 in the position of FIG. 3, and second stop means, for keeping the board 7 in the position of FIG. 2.

In the illustrated example, and as observable in FIG. 4 or 5, the abovementioned first stop means comprise a pair of rectilinear notches 16, aligned longitudinally therebetween, parallel to the front of the work top 2, which are defined in the upper surface of the lower board 6, sideway relative to the opening of the seat 14; as observable, these notches 16 are suitable to receive a portion of the front edge of the part 7*a* of the board 7, when it is in the condition of FIG. 3; the two notches 16 could be replaced by a single transverse notch, at a more advanced position with respect to the front of the seat 14.

The abovementioned second stop means comprise at least one, preferably two, stop members, mounted moveable on the structure and each suitable to acquire an idle condition and an operative condition, each member preferably being configured to autonomously move from the idle condition to the operative condition, due to the passage of the upper board 7 from the lowered configuration of FIG. 1 to a raised configuration, such as that of FIG. 2.

As observable in FIGS. 5-7, each stop member comprises a longitudinally extended element 17, for example made up of a square-sectioned rod whose side measures about 1 cm and length measures about 15 cm, and a spring, not shown; the rod 17 is subjected to receiving a spring and it has a first end hinged to the structure, for rotating according to a respective substantially horizontal axis, parallel to the front side of the work station 1.

As observable also in the schematic representation of FIG. 6, the arrangement is such that each rod 17 is kept in its idle condition by the weight of the upper board 7, when the latter is in its lowered configuration (FIG. 1); in such condition, each rod 17 is in a substantially reclined position, countering the reaction of the abovementioned spring inside the seat 14.

On the contrary, when the board part 7*a* is rotated with respect to the board part 7*b*, to move the upper board 7 towards a raised configuration, each rod 17 is rotated around a respective hinging axis, due to the action of the respective spring, until it acquires a substantially upright position; as observable in FIG. 7, in this upright position the second end of each rod 17 supports the upper board 7 substantially at the articulation region between the two parts 7*a* and 7*b*.

The rods 15 are preferably mounted in the seat 14, at the two lateral sides thereof; however it should be observed that in another possible embodiment, the rods 17 may be constrained to a part of the upper board 7, such as the rear part 7*b*.

The use of the two rods 17 and the lateral arrangement thereof is preferably for safety reasons, with the aim of making it difficult, for only one child, to close the board 7 from the inclined position to the completely flat position. Access to only one of the rods 15, to recline it towards the horizontal position, does not determine the lowering of the board 7, which still remains supported by the second rod 17. On the contrary, in order to free the board 7 from the support, it is necessary to recline and keep both rods low: this is an operation generally performable solely by an adult user and this allows reducing the risk of injury that non-adult users may be exposed to. Obviously, the rods 17 acquire an upright safety position, even when the board 7 is moved to the position of FIG. 3.

As mentioned previously, the workstation 1 may accommodate a computer unit, such as a personal computer. For such purpose, in the preferred embodiment, defined at the rear part of the structure of the work station is a compartment or seat for the computer unit, the latter being indicated with 18 in FIG. 5. In the example, this seat comprises a housing 19, inside the structure (also see FIGS. 6-7) which is provided with a door 20 rotating according to a substantially vertical axis; for such purpose, the door is hinged to the rear panel 4 through hinge means (not represented).

Advantageously associated to the door 20 are support means, for example made up of a shelf 21, for supporting the computer unit 18. As observable in FIG. 5, the shelf 21 is arranged in such a manner that, by opening the door 20—even slightly—the computer unit 18 is at least partly extracted from the respective housing 19, in such a manner to allow access to the front part of the computer unit, typically provided wherein are start controls, the USB connection ports, the removable disk drive units, the disk readers. The same moveable support system allows—when required—access to connectors located at the rear part of the unit 18, for installation or maintenance, by simply moving the door 20 to the fully open position, i.e. greater than 90° with respect to the opening of the housing 19.

Advantageously mounted in the housing 19 are other components of the work station, such as for example a sound amplifier or an element for controlling the display 5, if different from the computer unit 18.

Figure 8:
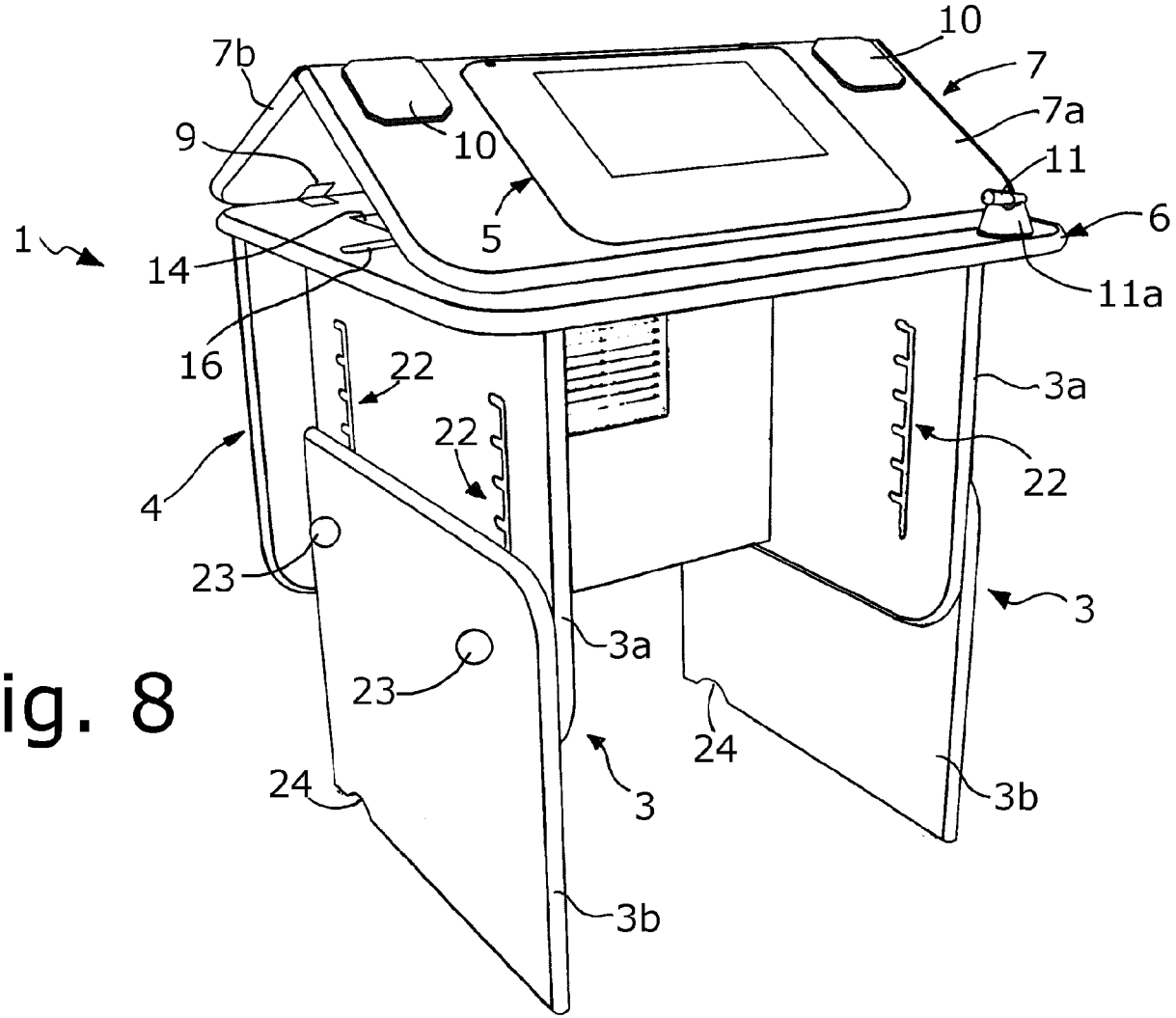
FIG. 8 is a perspective view similar to that of FIG. 2, but with different adjustment of the work station in height.

In the preferred embodiment, the bearing structure of the work station 1 is configured in such a manner to allow the adjustment of the work top 2 in height with respect to the floor, particularly from a minimum height, even lower than 50 cm, to a maximum height, comparable to that of a normal desk. This possibility to adjust is allowed by the composition of the lateral uprights 3 which, as particularly observable in FIG. 8, are each formed by two sliding sides 3*a* and 3*b*. Two sides 3*a* are integrally joined to at least the lower board 6 and they support it, while the other two sides 3*b*, mounted outwards with respect to the sides 6*a*, lie against the ground. The inner fixed sides 3*a* each have a pair of through grooves 22, substantially comb-shaped, parallel with respect to each other and arranged vertically. The outer sides 3*b* instead have two holes (not indicated). Housed in the grooves 22 are two pins for each part, non visible, constrained from within by a widened head, which keeps them in a respective groove 22, with the possibility to slide. The free end of the pins is threaded and passes through the abovementioned holes of the sides 3*b*, and screwed thereonto are respective knobs, indicated with 23, provided with a female screw.

Thus, as observable, the upright elements 3 each comprise two upright parts 3*a*-3*b*, secured with respect to each other through mutual coupling means represented by the abovementioned pins and knobs; these means may be operated to selectively and stably secure the two upright parts 3*a*-3*b* in a plurality of possible various respective positions.

Figure 9:
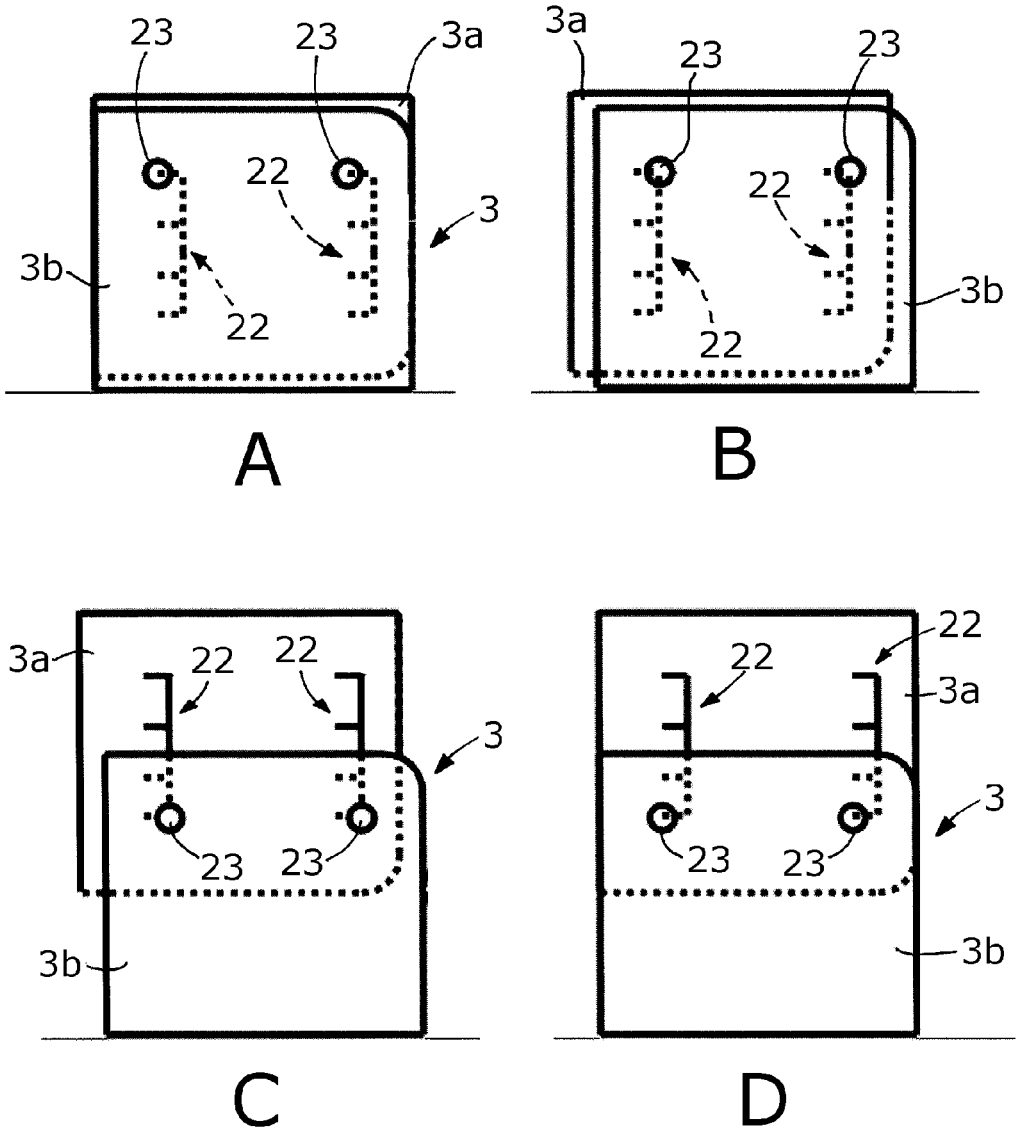
FIG. 9 is a schematic representation of four steps required to adjust the work station in height.

The adjustment requires the intervention of an adult given that, in order to be performed, one requires to loosen the knobs 23, which are usually tightly fastened and hence not manoeuvrable by children. The adjustment procedure, illustrated with reference to FIG. 9, is as follows and it should be first carried out on one side and then on the other side of the work station:

part A of FIG. 9: loosen the knobs 23 and slightly incline the workstation 1 on the side opposite to that being adjusted, by holding the workstation itself by the lower board 6; in this manner, the outer upright part 3*b* may slide with respect to the inner upright part 3*a;* part B of FIG. 9: move the outer upright part 3*b* sideways, by holding it by one of the knobs 23; in this manner, the pins of the two knobs 23 slip out of the respective horizontal parts of the grooves 22, to fit into the vertical parts of the same grooves; raise or lower the workstation 1, by inclining it more or less while it lies on the opposite upright;

part C of FIG. 9: move the outer upright part 3*b* in such a manner to cause the sliding of the pins of the knobs 23 within the vertical parts of the grooves 22, until the pins themselves face the horizontal parts of the grooves 22 corresponding to the desired adjustment height;

part D of FIG. 9: move the outer upright part 3*b* in the direction to engage the pins into the horizontal parts of the grooves 22 corresponding to the desired adjustment height, and fasten the knobs 23;

The same operations are then carried out on the opposite side of the work station 1.

It should still be pointed out that the connections between the devices that the workstation 1 is equipped with are mainly arranged inside the housing 19. Other connections may be obtained by accompanying the cables into ducts inserted into the thickness of the board 6 and/or 7. For example the cables for the display 5 and possible speakers 10 may exit from the seat 14 and then be conveyed into the lower part of the board 7, up to the devices. The presence of live cables outside the housing 19 is however preferably excluded.

Access to the main power cable preferably occurs through a hole in the lower part of the housing 19. Two grooves, indicated with 24, are defined in the lower part of the outer upright parts 3*b*, so as to allow the workstation 1 to be positioned above the floor ducts, with the aim of leaving the least possible part of live cables uncovered.

The workstation obtained according to the present invention is suitable for various purposes, particularly of didactic and educational type. This is highlighted by the preferred presence of various devices, well integrated in their entirety, that allow a high degree of interaction between the user and the machine: video, sound, pen, keyboard, mouse, microphone.

Highlighted among possible applications in the didactic field is the one that best exploits the display 5, with the Interactive Pen Display technology, and the respective Pen Tablet technology. These are applications for teaching how to write and read best useable for children within pre-school and school age. In particular, the possibility to write on the screen with the help of images and the voice recorded by an operator, offers a high degree of efficiency for specialized applications. To complete this function, particularly efficient is the possibility to "actually" write on a paper placed on the pen tablet using a ballpoint pen (even though special given the possibility to interface with the tablet itself). In addition, there is also the possibility to use all the didactic applications already currently available in the market for common personal computer workstations. In this case, the solution described above enhances the efficiency and simplicity of use of these didactic products, due to the presence of the pen as a pointing instrument as an alternative to the mouse.

In any case, it is clear how the idea on which the invention is based finds application with the aim of providing work stations even for uses different from didactic ones, for example for use in architecture, graphics, drawing, design firms (or customer service work stations of the "totem" type, etcetera.

The manufacturing details and the embodiments may widely vary with respect those described and illustrated strictly for exemplifying purposes, without departing from the scope of the invention, as defined by the claims that follow.

The lower board 6 could also be smaller with respect to the upper board 7; for example, the board 6 could be shorter—in terms of the depth of the work station—with respect to the board 7, however in such a manner to guarantee the presence of a support surface in the front zone of the work station 1, when the board 7 is in a raised configuration. The lower board 6 could possibly be articulated to the sides 3, for rotating about an axis substantially parallel to axes A and B.

The invention claimed is:

1. A workstation for computers, having a structure comprising:

a work top and upright elements supporting the work top, an electronic display device being mounted on the work top;

the work top comprising a lower board, stably coupled to the upright elements, and an upper board, overlapping the lower board and displaceable relative to the lower board, the upper board being subdivided into at least one front board part and one rear board part articulated to each other;

the electronic display device being a substantially flat display device and secured on the front board part in a laying position substantially parallel to the front board part;

the front and rear board parts articulated to rotate relative to each other about a substantially horizontal first axis, such that the upper board is adapted to selectively take on a plurality of different configurations, to which different positions of use of the electronic display device correspond, among which at least a lowered configuration, wherein the front and rear board parts are essentially parallel to the lower board, and one or more raised configurations, in which, or in each of which, the lower surfaces of the front board part and the rear board part form a lower angle therebetween which is smaller than 180°;

the structure provided with stop means for keeping the front and rear board parts in said at least one raised configuration;

wherein the upper board is adapted to take on at least a first and a second raised configuration, the lower angles formed between the lower surfaces of the front and rear board parts being different in the first and the second raised configuration, such that the display device results in being oriented with correspondingly different inclinations;

wherein the stop means comprise:

first stop means, to keep the upper board in the first raised configuration, and second stop means, to keep the upper board in the second raised configuration; and wherein one of the first and second stop means comprises at least one stop member mounted on the structure and adapted to take on a rest condition and a work condition, the at least one stop member being prearranged to shift autonomously from the rest condition to the work position following upon shifting of the upper board from said lowered configuration to one said raised configuration.

2. The workstation according to claim 1, wherein the rear board part is articulated to the lower board for rotating about a further axis, which is substantially horizontal and parallel to the first axis, the two axes being substantially parallel to a front of the workstation, in the raised configuration, or in each raised configuration, the first axis lying at a higher height than the further axis.

3. The workstation according to claim 1, wherein the front board part and the rear board part have each a front region and a rear region, between the rear region of the front board part and the front region of the rear board part first hinge means are mounted for articulating the front and rear board parts to each other, and between the rear region of the rear board part and a rear region of the lower board second hinge means are mounted for articulating the rear board part to the lower board.

4. The workstation according to claim 1, wherein a seat is defined in the structure, said seat being accessible when the upper board is brought to take on at least temporarily one said raised configuration.

5. The workstation according to claim 4, wherein the seat is a seat for storing at least one input device selected from a computer keyboard and a mouse.

6. The workstation according to claim 1, wherein the electronic display device is an interactive display device, or functioning at the same time as input device and output device.

7. The workstation according to claim 6, wherein the electronic display device is a Touch Screen display devices or an Interactive Pen Display device.

8. The workstation according to claim 1, wherein the structure has one seat for a computer unit, the seat comprising a housing having a door that is rotatable about a substantially vertical axis, support means being associated to the door for supporting the computer unit and arranged such that, by opening the door, the computer unit is at least partially extracted from the housing.

9. The workstation according to claim 1, wherein the upright elements comprise each at least two upright parts that can be secured to each other, through mutual coupling means, in a plurality of different relative positions, to allow for the height adjustment of the work top.

10. The workstation according to claim 1, wherein one of the first and second stop means comprises at least one seat or notch of the upper surface of the lower board capable of receiving at least one front edge portion of the front board portion.

11. The workstation according to claim 1, wherein one of the first and second stop means comprises a longitudinally extended member having a first end constrained to the structure for rotating about a respective substantially horizontal hinge axis, wherein the longitudinally extended member is in a substantially reclined position when the upper board is in said lowered configuration, and, when the front board part is made to rotate relative to the rear board part, to bring the upper board in one said raised configuration, the longitudinally extended member is made to rotate about the respective hinge axis, for taking on a substantially upright position, in which a second end of the longitudinally extended member support the upper board at an articulation region between the front board part and the rear board part.

12. The workstation according to claim 1, wherein, in at least one said raised configuration, a substantial portion of the lower board is in view to realize a support surface.

13. The workstation according to claim 12, wherein, in said at least one raised configuration, said substantial portion of the lower board which is in view realizes a support surface for at least one an input device selected from a keyboard, a mouse, an optical pen, a pen tablet.

14. A workstation for computers, having a structure comprising:

a work top and upright elements supporting the work top, an electronic display device being mounted on the work top;

the work top comprising a lower board, stably coupled to the upright elements, and an upper board, overlapping the lower board and displaceable relative to the lower board, the upper board being subdivided into at least one front board part and one rear board part articulated to each other;

the electronic display device being a substantially flat display device and secured on the front board part in a laying position substantially parallel to the front board part;

the front and rear board parts articulated to rotate relative to each other about a substantially horizontal first axis, such that the upper board is adapted to selectively take on a plurality of different configurations, to which different positions of use of the electronic display device correspond, among which at least a lowered configuration, wherein the front and rear board parts are essentially parallel to the lower board, and one or more raised configurations, in which, or in each of which, the lower surfaces of the front board part and the rear board part form a lower angle therebetween which is smaller than 180°;

the structure provided with stop means for keeping the front and rear board parts in said at least one raised configuration;

wherein the electronic display device is mounted at the upper surface of the front board part, such that the electronic display device is in view also in said lowered configuration; and wherein the stop means comprise at least one stop member mounted on the structure and adapted to take on a rest condition and a work condition, the at least one stop member being prearranged to shift from the rest condition to the work position following upon shifting of the upper board from said lowered configuration to one said raised configuration.

15. The workstation according to claim 14, wherein the front board part and the rear board part have each a front region and a rear region, between the rear region of the front board part and the front region of the rear board part hinge means being mounted for articulating the front and rear board parts to each other, for rotating about said substantially horizontal first axis.

16. The workstation according to claim 14, wherein the rear board part is articulated to the lower board for rotating about a further axis, which is substantially horizontal and parallel to the first axis, the two axes being substantially parallel to a front of the workstation, in the raised configuration, or in each raised configuration, the first axis lying at a higher height than the further axis.

17. The workstation according to claim 14, wherein the upper board is adapted to take on at least a first and a second raised configuration, the lower angles formed between the lower surfaces of the front and rear board parts being different in the first and the second raised configuration, such that the display device results in being oriented with correspondingly different inclinations.

18. A workstation for computers, having a structure comprising:

a work top and upright elements supporting k top, an electronic display device being mounted on the work top;

the work top comprising a lower board, stably coupled to the upright elements, and an upper board, overlapping the lower board and displaceable relative to the lower board, the upper board being subdivided into at least one front board part and one rear board part articulated to each other;

the electronic display device being a substantially flat display device and secured on the front board part in a laying position substantially parallel to the front board part;

the front and rear board parts articulated to rotate relative to each other about a substantially horizontal first axis, such that the upper board is adapted to selectively take on a plurality of different configurations, to which different positions of use of the electronic display device correspond, among which at least a lowered configuration, wherein the front and rear board parts are essentially parallel to the lower board, and one or more raised configurations, in which, or in each of which, the lower surfaces of the front board part and the rear board part form a lower angle therebetween which is smaller than 180°;

the structure provided with stop means for keeping the front and rear board parts in said at least one raised configuration;

wherein the electronic display device is mounted at the upper surface of the front board part, such that the electronic display device is in view also in said lowered configuration;

wherein the stop means comprise at least two longitudinally extended stop members substantially parallel to each other, each longitudinally extended stop member having a first end constrained to the structure for rotating about a respective substantially horizontal hinge axis; and wherein the longitudinally extended stop members are in a substantially reclined position when the upper board is in said lowered configuration, and, when the front board part is made to rotate relative to the rear board part, to bring the upper board in one said raised configuration, the longitudinally extended stop members are rotatable about the respective hinge axis, for taking on a substantially upright position, in which a second end of the longitudinally extended stop members supports the upper board at an articulation region between the front board part and the rear board part.

* * * * *

UNITED STATES PATENT AND TRADEMARK OFFICE

CERTIFICATE OF CORRECTION

PATENT NO. : 8,596,204 B2
APPLICATION NO. : 13/262393
DATED : December 3, 2013
INVENTOR(S) : Daniele Costamagna It is certified that error appears in the above-identified patent and that said Letters Patent is hereby corrected as shown below:

In the Claims:

Column 10, Line 47: Claim 18, Delete "k" and insert --the work--

Signed and Sealed this
Eighteenth Day of February, 2014

Michelle K. Lee

Michelle K. Lee
*Deputy Director of the United States Patent and Trademark Office*